US005419992A

United States Patent [19]

Mychajlowskij et al.

[11] Patent Number: 5,419,992

[45] Date of Patent: May 30, 1995

[54] ARYL AMINE POLYCONDENSATION POLYMERS

[75] Inventors: Walter Mychajlowskij, Georgetown; George Liebermann, Mississauga, both of Canada; William W. Limburg, Penfield; John F. Yanus, Webster, both of N.Y.; Dasarao K. Murti, Mississauga, Canada

[73] Assignee: Xerox Corporation, Stamford, Conn.

[21] Appl. No.: 36,162

[22] Filed: Mar. 24, 1993

[51] Int. Cl.[6] ..... G03G 15/02

[52] U.S. Cl. ..... 430/59; 430/58; 430/76; 430/78

[58] Field of Search ..... 430/59, 58, 76, 78

[56] References Cited

U.S. PATENT DOCUMENTS

| | | | |
|---|---|---|---|
| 4,265,990 | 5/1981 | Stolka et al. | 430/59 |
| 4,772,525 | 9/1988 | Badesha et al. | 430/58 |
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 5,028,687 | 7/1991 | Yanus et al. | 528/203 |

*Primary Examiner*—Marion E. McCamish
*Assistant Examiner*—Mark A. Chapman
*Attorney, Agent, or Firm*—E. O. Palazzu

[57] ABSTRACT

A process for the preparation of aryl amine polycondensation polymers useful in electrophotographic imaging members, which process comprises the interfacial polymerization of an aryl amine diol dissolved in an alkaline aqueous phase with a bifunctional acid halide dissolved in an organic solvent, resulting in polymers with high molecular weight and narrow molecular weight distribution ($M_w/M_n$) of from between about 50,000 to about 350,000, and a $M_w/M_n$ of from about 1 to about 4.

11 Claims, No Drawings

ARYL AMINE POLYCONDENSATION POLYMERS

BACKGROUND OF THE INVENTION

The present invention is directed generally to processes for the preparation of aryl amine polycondensation polymers, and photoconductive imaging members thereof. More specifically, the present invention is directed to processes for the preparation of aryl amine poly(ethercarbonates) which can be selected as a charge transport layer in a layered photoconductive imaging member with a photogenerating layer and a supporting substrate. Aryl amine polymers usable in electrophotographic imaging processes are described, for example, in U.S. Pat. Nos. 4,801,517; 4,806,444 and 4,806,443, the disclosures of which are totally incorporated herein by reference. U.S. Pat. Nos. 4,806,443 and 5,028,687 disclose aryl amine poly(ethercarbonates), a solution polymerization process for the preparation of aryl amine poly(ethercarbonates), and the use of these polycarbonates in imaging systems.

The present invention relates to interfacial polymerization (IFP) processes for the synthesis of the aforementioned aryl amine poly(ethercarbonates). With interfacial polymerization instead of solution polymerization, there is enabled certain molecular weight polymers with narrow molecular weight distributions (MWD). Also, a significant improvement in the mechanical properties, including wear resistance is obtained with the products obtained with the processes of the present invention. For example, the wear resistance of imaging members containing the polymers of the present invention is improved by a factor of about 2 to 3 as compared to typical photoreceptor charge transport layers comprised of charge transporting small molecules, such as N,N'-diphenyl-N,N'-bis(3-methylphenyl)-[1,1'-biphenyl]-4,4'-diamine (TPD), dissolved or dispersed in various polymers, such as polycarbonates like bisphenol A polycarbonate, including MAKROLON 5705®. One embodiment of the present invention is directed to an imaging member comprised of a supporting substrate, a photogenerating layer comprised of photogenerating pigments in contact therewith, and a charge, especially hole transport layer, comprised of the aryl amine poly(ethercarbonates) obtained with the processes as illustrated herein. The aforementioned imaging members are also useful in liquid development systems in that, for example, the members thereof can be resistant to cracking, crystallization, and brazing, and such imaging members are resistant to liquid developer components containing hydrocarbon type solvents, such as ISOPAR® and NORPAR®, in that, for example, they retain their electrical and mechanical characteristics for extended time periods.

U.S. Pat. No. 4,806,443 describes a solution polymerization process for the preparation of aryl amine poly(ethercarbonates). Solution polycondensation involves the reaction of a dihydroxy aryl amine with a glycol bischloroformate in an appropriate solvent and in the presence of an organic base. The solution process yields polymers with relatively low molecular weights, such as from between about 40,000 to about 150,000 when a high purity dihydroxyaryl amine monomer is used. When the dihydroxyaryl amine monomer used contains small amounts of polyfunctional impurities, the polymer obtained can have a high molecular weight ($M_w$ over 200,000), however, the molecular weight distributions ($M_w/M_n$ or MWD) are wide, of the range of 3 to 12. Materials with low molecular weights and/or wide molecular weight distributions suffer from poor mechanical performance in photoreceptor applications such as excessive wear and cracking. For purposes of increasing the molecular weight to about 200,000 to 300,000, there have been introduced during the polymerization reaction thereof crosslinking agents such as 1,3,5-benzenetricarbonyl trichloride, tri(4-hydroxyphenyl)ethane or 3,3', 3'', 3'''-tetrahydroxytetraphenylbenzidine. However, the use of crosslinking agents causes difficulties in controlling the molecular weight, results in high molecular weight distributions, and can cause problems in electrical properties of the polymer, as well as causing difficulties in processability due to increases in solution viscosities. To reduce the molecular weight distributions and thus improve the mechanical properties of these materials, fractionation is accomplished, generally by the selective precipitation of higher molecular weight polymer. This can result in poor yields of the desired polymer. These and other disadvantages are avoided, or minimized with the polycarbonates obtained with the processes of the present invention.

Photoresponsive imaging members are known, such as those with a homogeneous layer of a single material such as vitreous selenium, or composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder.

Photoreceptor materials comprising inorganic or organic materials wherein the charge generating and charge transport functions are performed by discrete continuous layers are also known. Additionally, layered photoreceptor members are disclosed in the prior art, including photoreceptors having an overcoat layer of an electrically insulating polymeric material. Other layered photoresponsive devices have been disclosed, including those comprising separate photogenerating layers and charge transport layers as described in U.S. Pat. Nos. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin are disclosed in U.S. Pat. No. 4,251,612, the disclosure of which is totally incorporated herein by reference. Examples of photogenerating layers disclosed in these and other patents include trigonal selenium and phthalocyanines, perylenes, and azo compounds, while examples of transport layers include certain aryl diamines as illustrated therein.

Layered photoconductive imaging members useful with liquid development systems are illustrated in U.S. Pat. Nos. 4,801,517; 4,806,443 and 4,806,444 mentioned herein.

SUMMARY OF THE INVENTION

It is an object of the present invention to provide aryl amine polycondensation polymers, and imaging members thereof with many of the advantages illustrated herein.

It is another object of the present invention to provide aryl amine poly(ethercarbonates) and poly(ethercarbonates), and abrasion resistant imaging members thereof with many of the advantages illustrated herein; and wherein crosslinking components and phosgene may be avoided.

It is another object of the present invention to provide processes for the preparation of aryl amine poly(ethercarbonates) with improved mechanical characteristics.

Still another object of the present invention is to provide interfacial components, such as polymerization (IFP) processes for the preparation of charge transport polycondensation poly(ethercarbonates), including aryl amine poly(ethercarbonates), and photoconductive imaging members thereof useful in liquid, such as liquid immersion, and dry development systems.

It is another object of the present invention to provide interfacial polymerization processes for the preparation of charge transport poly(ethercarbonates), such as aryl amine poly(ethercarbonates), with high molecular weights of, for example, from between about 50,000 to about 350,000, more preferably from about 75,000 to about 250,000 and with a narrow molecular weight distribution ($M_w/M_n$) of, for example, from about 1.5 to about 3.0. A narrow molecular weight polymer distribution is preferred for providing the mechanical wear resistance thereby increasing the life of the photoreceptor to, for example, it is believed, 1,000,000 imaging cycles. A preferred molecular weight is determined by the solubility of the polymer in solvents of choice for photoreceptor fabrication as well as the solution viscosity at a given molecular weight of the polymer. The method of photoreceptor fabrication, such as for example doctor blade coating, dip coating, spray coating and gravure coating methods, has certain viscosity requirements at a specified solids content used, therefore, polymers with certain molecular weights need to be selected.

It is, therefore, another object of the present invention to provide interfacial polymerization processes for the preparation of charge transport poly(ethercarbonates), such as aryl amine poly(ethercarbonates), generally with higher molecular weights than obtained with known solution polycondensation processes, while retaining a narrow molecular weight distribution.

It is another object of the present invention to provide interfacial polymerization processes for the preparation of charge transport poly(ethercarbonates), such as aryl amine poly(ethercarbonates), with increased resistance to abrasion when exposed to blade cleaning devices than obtained with known solution polycondensation processes.

Another object of the present invention is to provide interfacial polymerization processes for the preparation of poly(ethercarbonates), such as aryl amine poly(ethercarbonates), wherein the stoichiometric control of reactant amounts required for a solution polymerization is avoided, and very high purity starting reactants, such as N,N'-diphenyl-N,N'-bis(3-hydroxyphenyl)[1,1'-biphenyl]-4,4'-diamine are not needed to avoid crosslinking. The interfacial polymerization processes of the present invention also enable control, that is the lowering or raising, of the molecular weight by, for example, simply varying the amount, or type of phase transfer catalyst selected. Moreover, the interfacial polymerization processes of the present invention avoid the use of crosslinking agents as a method to obtain high molecular weight polymers, which crosslinkers introduce processing problems such as low solubility and increased viscosity.

These and other objects of the present invention can be accomplished in embodiments by the provision of processes for the preparation of aryl amine polycondensation polymers and poly(ethercarbonates). The processes of this invention enables aryl amine polycondensation polymers, such as aryl amine poly(ethercarbonates), which are suitable for use in image receptors, especially as active binders for the charge transport layer or charge generating layer of a photoreceptor such as those illustrated in U.S. Pat. No. 4,265,990, the disclosure of which is totally incorporated herein by reference.

More specifically, the present invention in embodiments is directed to interfacial polycondensation polymerizations for the preparation of aryl amine polycondensation polymers such as poly(ethercarbonates) with high molecular weights ($M_w$), such as for example from between about 75,000 and 300,000 and with narrow molecular weight distributions ($M_w/M_n$), such as for example from between about 1.5 to about 3.0, which narrow molecular weight distribution is preferred for providing superior mechanical wear resistance which enables long life photoreceptors, such as for 1,000,000 imaging cycles in a Xerox Corporation 5090 imaging type test fixture. In these processes, diols containing aryl amine groups are reacted with diacid halides, preferably bishaloformates, to enable aryl amine polycondensation polymers, preferably aryl amine poly(ethercarbonates).

In embodiments, the process of the present invention comprises an interfacial polymerization by the reaction of a dihydroxyaryl amine compound, or an aryl amine diol with diacid halides.

To prepare the aryl amine polymer illustrated herein by interfacial polycondensation, an aqueous solution of a dihydroxyaryl amine compound may be formed, preferably at a strongly basic pH to allow for the aryl amine diol to dissolve into the aqueous solution. An organic solution of a diacid halide, for example a bishaloformate, is then added and the polymerization performed at the desired temperature. The interfacial polycondensation is preferably accomplished with a phase transfer agent or catalyst, which allows the aryl amine diol to be transferred from the aqueous phase into an organic phase.

More specifically, the process of the present invention comprises dissolving a dihydroxyaryl amine in water with stirring in the presence of an alkali metal hydroxide and a phase transfer agent. The aqueous solution preferably has a strongly basic pH, for example about 12 or higher, to allow for the diol to dissolve into the aqueous solution. The aqueous solution contains the phase transfer agent, such as an arylalkyl ammonium halide, which allows the reaction to occur at the interface of the aqueous and organic phases as the diol is transferred from the aqueous phase into an organic phase. A solution comprised of the diacid halide, such as an alkylene glycol bishaloformate, in a suitable organic solvent is then added and the polymerization performed usually at room temperature or below.

The aqueous solution has a weight percent ratio of the dihydroxyaryl amine to water of from 0.01 to 0.50 and preferably from about 0.05 to about 0.20, while the molar ratio of alkali metal hydroxide to the dihydroxy aryl amine is from about 1 to about 5 and preferably from about 1.0 to about 2.0, and the concentration of arylalkyl ammonium halide to dihydroxy aryl amine is from about 0.1 to about 20 percent and preferably from about 1 to about 10 percent. The dissolution of the dihydroxy aryl amine can be accomplished by heating the mixture at, for example, a temperature of from about 75° to about 95° C., and preferably 85° C., under an inert atmosphere. The solution is then cooled to, for example, a temperature of from 0° to 25° C. and preferably from 0° to 10° C. Thereafter, there is added, with vigorous stirring, to the cooled solution over a period of time, for example from between about 0.1 and about 2 and preferably 0.5 to 1 hour, a solution comprised of the diacid halide such as an alkylene glycol bischloroformate in a suitable organic solvent. The diacid halide can be selected in various effective amounts, such as a molar ratio of 1.0 to 2.0, to the dihydroxyaryl amine and preferably from about 1.05 to 1.25. Suitable organic solvents include, but are not limited to, alkylene halides, such as methylene chloride, carbon tetrachloride, dichloroethane, tetrachloroethane, chloro benzenes, toluene and xylene. Methylene chloride is the preferred organic solvent. The weight percent ratio of the alkylene glycol bischloroformate to organic solvent can range from about 0.01 to about 0.50 and preferably from about 0.05 to about 0.20. After addition, the reaction mixture is allowed to warm up to room temperature and further stirred for a period of time from about 1 to 16 hours and preferably from about 1 to 5 hours. The resulting mixture is retained at room temperature until phase separation results, and the organic phase comprised of the organic solvent and the polymer is separated from the alkaline water phase. Subsequent to washing with, for example, water, the organic phase is then precipitated into an aliphatic alcohol with, for example, from 1 to about 20 carbon atoms, such as methanol, ethanol, propanol, butanol, and the like. The polymer resulting is isolated by, for example, filtration, and thereafter the polymer is dried in an oven at, for example, a temperature of about 40° C. The product was then identified as aryl amine poly(ethercarbonate) by NMR and IR. This polymer had a weight average molecular weight determined by gel permeation chromatography of from between about 50,000 and about 320,000, and a molecular weight distribution of 1.5 to 3.0. When a similar process was accomplished with a solution polycondensation, the molecular weight ($M_w$) of the poly(ethercarbonate) was about 200,000 to about 300,000 and the molecular weight distribution was 3.5 to 12.0. When the polymerization was accomplished with a solution polycondensation using a very high purity monomer, the molecular weight ($M_w$) of the poly(ethercarbonate) was about 50,000 to about 150,000. Details of the corresponding solution polycondensation process can be located in U.S. Pat. No. 4,806,443, the disclosure of which is totally incorporated herein by reference.

Typical dihydroxyaryl amine compounds selected in effective amounts are illustrated in U.S. Pat. Nos. 4,588,666; 4,801,517; 4,806,443 and 4,806,444, the disclosures of which are totally incorporated herein by reference. The dihydroxyaryl amine may be any suitable diol, including, but not limited to, N,N'-diphenyl-N,N'-bis(3-hydroxyphenyl)-[1,1'-biphenyl]-4,4'-diamine, 3,5-dihydroxyphenyl-9-dicyanomethylenefluorene-4-carboxylate, N,N-bis(4-biphenyl)-3,5-dihydroxyaniline, or bis(m-hydroxyphenyl)-4-biphenylamine.

The diacid halide selected in effective amounts may be any suitable diacid halide, such as a bishaloformate, preferably a bischloroformate. Typical glycol bischloroformate compounds, which can be employed, are ethylene glycol bischloroformate, diethylene glycol bischloroformate, triethylene glycol bischloroformate and propylene glycol bischloroformate.

The phase transfer agent selected in effective amounts may be any suitable transfer agent, such as an arylalkyl ammonium halide, such as benzyltriethylammonium chloride, benzyltrimethylammonium chloride, benzyldimethyldodecylammonium bromide, benzyldimethylstearylammonium chloride, benzyldimethyltetradecylammonium chloride, benzyltributylammonium chloride, bromide or iodide, butyltripropylammonium bromide, cetyldimethylethylammonium bromide, cetyltrimethylammonium bromide or chloride, tetrabutylammonium bromide, chloride, fluoride or iodide, tetraethylammonium bromide, chloride, fluoride or iodide, tetramethylammonium bromide, chloride, fluoride or iodide, tetrapropylammonium bromide, chloride, fluoride or iodide, benzyltriphenylphosphonium chloride or bromide, methyltriphenylphosphonium bromide, methyltriphenylarsonium iodide, cetylpyridinium chloride or hexadecyltributylphosphonium bromide, and the like.

One layered photoconductive imaging member can be comprised of a conductive metal, such as aluminum supporting substrate, a photogenerating layer comprising an inorganic, or an organic photogenerating pigment, such as trigonal selenium, titanyl phthalocyanine, vanadyl phthalocyanine, and the like optionally dispersed in a resinous binder composition and a charge transport layer which comprises an aryl amine polycondensation polymer obtained with the process of the present invention as charge transporting moiety dispersed in an inactive resinous binder.

A photoconductive imaging member of the present invention also can be comprised of a conductive substrate, a hole blocking metal oxide layer thereover, an optional adhesive layer thereover, a photogenerating layer comprised of trigonal selenium dispersed in a resinous binder composition, and an aryl amine poly(ethercarbonate) with an $M_w$ of 236,000 and an $M_n$ of 110,000 transport layer as the top layer, optionally dispersed in a resinous binder.

Examples of photogenerating pigments, substrates, adhesive layers, and the like are known, reference for example U.S. Pat. No. 4,801,517, the disclosure of which is totally incorporated herein by reference.

The substrate can be formulated entirely of an electrically conductive material, or it can be an insulating material having an electrically conductive surface. The substrate thickness is, for example, about 100 mils, and preferably from about 1 to about 50 mils. Thus, this layer may be of substantial thickness, for example over 100 mils, or of minimal thickness provided that there are no adverse effects on the member or device. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include nickel, stainless steel, conductive plastics, aluminum, semitransparent aluminum, titanium, and the like. The substrate can be of any other conventional material, including organic and inorganic materials. Typical substrate materials include insulating nonconducting materials, such as various resins known for this purpose including polycarbonates, polyamides, polyurethanes, paper, glass, plastic, polyesters, such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

The photoconductive imaging member may optionally contain a charge blocking layer situated between the conductive substrate and the photogenerating layer. The thickness of this layer is between, for example, about 50 Angstroms to about 10 microns, and preferably about 1 micron. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging.

In embodiments, intermediate adhesive layers situated between the substrate and subsequently applied layers may be desirable to improve adhesion. These adhesive layers are preferably of a thickness of from about 0.1 micron to about 5 microns. Typical adhesive layers include film-forming polymers such as polyester, polyvinylbutyral, polyvinylpyrrolidone, polycarbonate, polyurethane, polymethyl methacrylate, and the like; as well as mixtures thereof. Since the surface of the substrate can be a metal oxide layer or an adhesive layer, the expression "substrate" as employed herein is intended to include in embodiments a metal oxide layer with or without an adhesive layer on a metal oxide layer.

In addition, the photoconductive imaging member may also optionally contain an adhesive interface layer situated between the hole blocking layer and the photogenerating layer. This layer may comprise a polymeric material, such as polyester, polyvinyl butyral, polyvinyl pyrrolidone, and the like.

The photogenerating layer comprises, for example, known metal phthalocyanines, metal free phthalocyanines, vanadyl phthalocyanines, titanyl phthalocyanines, squaraines, perylenes, selenium, selenium alloys, such as selenium tellurium, trigonal selenium, and the like. Generally, this layer has a thickness of from between about 0.05 micron to about 10 microns or more, and in embodiments has a thickness of from about 0.1 micron to about 3 microns. The thickness of this layer is dependent primarily upon the concentration of photogenerating material in the layer, which may generally vary from about 5 to 100 percent. When the photogenerating material is present in a binder material, the binder preferably contains from about 30 to about 95 percent by weight of the photogenerating material, and preferably contains about 80 percent by weight of the photogenerating material.

Active carrier transport resins may be employed as the binder in the photogenerating layer. These resins are particularly useful where the concentration of carrier generating pigment particles is low and the thickness of the carrier generating layer is substantially thicker than about 0.7 micrometer. The active resin commonly used as the binder is polyvinylcarbazole whose function is to transport carriers which would otherwise be trapped in the layer.

The electrically active aryl amine polycondensation polymers of the present invention can be employed in the generator layer replacing the polyvinylcarbazole binder or other active or inactive binder. Part or all of the active resin materials to be employed in the generator layer may be replaced by the electrically active aryl amine polycondensation polymers of this invention.

The active charge transport layer comprises an aryl amine polycondensation polymer obtained with the processes of the present invention and capable of supporting the injection of photogenerated holes from the charge generation layer and allowing the transport of these holes through the transport layer to selectively discharge the surface charge. Generally, this layer has a thickness of from between about 3 microns to about 50 microns, and in embodiments this layer has a thickness of from about 10 microns to about 30 microns. When the photogenerating layer is sandwiched between the conductive layer and the active charge transport layer, the transport layer not only serves to transport holes, but also protects the photoconductive layer from abrasion or chemical attack and therefore extends the operating life of the electrophotographic imaging member. The charge transport layer should exhibit negligible, if any, discharge when exposed to a wavelength of light useful in xerography, e.g. 4,000 Angstroms to 9,000 Angstroms. Therefore, the charge transport layer is substantially transparent to radiation in a region in which the photoconductor is to be used. Thus, the active charge transport layer is a substantially nonphotoconductive material which supports the injection of photogenerated holes from the generator layer. The active transport layer is normally transparent when exposure is affected there through to ensure that most of the incident radiation is utilized by the underlying charge carrier generator layer for efficient photogeneration. When used with a transparent substrate, imagewise exposure may be accomplished through the substrate with all the light passing through the substrate. In this case, the active transport material need not be transmitting in the wavelength region used. The charge transport layer in conjunction with the generation layer in the instant invention is a material which is an insulator to the extent that an electrostatic charge placed on the transport layer is not conducted in the absence of illumination.

Part or all of the transport material comprising hole transporting small molecules in an inactive binder to be employed in the transport layer may be replaced by the active materials of this invention comprising an aryl amine polycondensation polymer film forming-material. The hole transporting small molecule-inactive resin binder composition may be entirely replaced with 100 percent of an aryl amine polycondensation polymer of the present invention.

An especially preferred transport layer employed in one of the two electrically operative layers in the multilayer photoconductor of this invention comprises from about 50 percent to about 100 percent by weight of poly[N,N'-diphenyl-N,N'-bis{3-hydroxyphenyl}-{1,1'-biphenyl}-4,4'diamine] diethylene glycol biscarbonate, and from about 0 percent to about 50 percent by weight of bisphenol A polycarbonate.

The electrophotographic member of the present invention exhibits greater resistance to cracking, brazing, crystallization, and phase separation compared to similar imaging members using nonpolymeric aryl amine compounds. It also exhibits significantly improved resistance to abrasion when exposed to blade cleaning devices compared to similar imaging members using nonpolymeric aryl amine compounds or aryl amine polycondensation polymers obtained by solution polycondensation.

Specific embodiments of the invention will now be described in detail. These Examples are intended to be illustrative, and the invention is not limited to the materials, conditions, or process parameters set forth in these embodiments. All parts and percentages are by weight unless otherwise indicated. Comparative information is also presented.

EXAMPLE I

Following the solution polymerization of U.S. Pat. No. 4,806,443, the disclosure of which is totally incorporated herein by reference, poly[N,N'-diphenyl-N,N'-bis{3-hydroxyphenyl}-{1,1'-biphenyl}-4,4'-diamine] diethylene glycol biscarbonate was prepared. The molecular weight, as determined by gel permeation chromatography, against a polystyrene standard was $M_w$ 200, 000 and $M_n$ 53,000 ($M_w/M_n$ or MWD 3.79). In another process, by the solution polymerization of U.S. Pat. No. 4,806,443, poly[N,N'-diphenyl-N,N'-bis{3-hydroxyphenyl}-{1,1'-biphenyl}-4,4'-diamine] diethylene glycol biscarbonate was prepared, and had an $M_w$ of 311,000 and an $M_n$ of 28,800 (MWD 10.8). The high molecular weight and the wide molecular weight distribution (MWD over 3.0) of the polymers obtained is an indication that the monomer, N,N'-di(3-hydroxyphenyl)-N,N'-diphenyl-{1,1'-biphenyl}-4,4'-diamine, contains small amounts of polyhydroxy derivatives.

EXAMPLE II

Poly[N,N'-diphenyl-N,N'-bis{3-hydroxyphenyl}-{1,1'-biphenyl}-4,4'-diamine] diethylene glycol biscarbonate was prepared by the interfacial polymerization process of the present invention. Into a 500 milliliter three-neck flask equipped with a mechanical stirrer, a thermometer and a nitrogen gas inlet were placed 5.6 grams of potassium hydroxide (0.1 moles), 0.9 gram of benzyltriethylammonium chloride, 120 milliliters of water and 10.4 grams of N,N'-bis[3-hydroxyphenyl]-N,N'-diphenyl-[1,1'-biphenyl]-4,4'-diamine (0.02 moles). The N,N'-di(3-hydroxyphenyl)-N,N'-diphenyl-{1,1'-biphenyl}-4,4'-diamine was obtained following the procedure described in Example 2 of U.S. Pat. No. 4,806,443, the disclosure of which is totally incorporated herein by reference. The solution was stirred under nitrogen and heated to 85° C. in a water bath to obtain a clear yellow solution. The solution was then cooled to 5° C. in an ice water bath. To this solution was added with vigorous stirring, over a period of one hour, a solution of 5.0 grams of diethylene glycol bischloroformate in 120 milliliters of methylene chloride. The solution was stirred for an additional hour at room temperature, about 25° C., with a noticeable increase in solution viscosity. An additional 100 milliliters of methylene chloride was added to the mixture. The mixture was then transferred to a separatory funnel and the organic phase separated from the alkaline water phase. The organic phase was washed with 3×150 milliliters of water until the water phase was neutral (pH 7). The solution was then precipitated into 2.5 liters of methanol. The polymer was filtered and dried. Yield of polymer was 10.4 grams, and the molecular weight, determined by gel permeation chromatography against a polystyrene standard, was $M_w$ 241,300 and $M_n$ 108,900 (MWD 2.2).

EXAMPLE III

Following the solution polymerization procedure of Example I and U.S. Pat. No. 4,806,443, poly[N,N'-diphenyl-N,N'-bis{3-hydroxyphenyl}-{1,1'-biphenyl}-4,4'-diamine] diethylene glycol biscarbonate was prepared using the N,N'-di(3-hydroxyphenyl)-N,N'-diphenyl-{1,1'-biphenyl}-4,4'-diamine of Example II. Molecular weight, determined by gel permeation chromatography against a polystyrene standard, was $M_w$ 143,000 and $M_n$ 77,000 (MWD 1.86), compared with $M_w$ 236,000 and $M_n$ 110,000 (MWD 2.14) obtained by the interfacial polymerization process of Example II. A series of solution and interfacial polymerizations were accomplished using different N,N'-di(3-hydroxyphenyl)-N,N'-diphenyl-{1,1'-biphenyl}-4,4'-diamine samples prepared as described in U.S. Pat. No. 4,806,443. These samples showed various degrees of purity by HPLC, and contained, for example, reactive impurities such as monohydroxy- or polyhydroxy-derivatives. AsN,N'-di(3-hydroxyphenyl)-N,N'-diphenyl-{1,1'-biphenyl}-4,4'-diamine samples contain small amounts of monohydroxy- or polyhydroxy-derivatives; the molecular weight of the polymers obtained can vary as a function of the level and type of these impurities. As shown in Table 1, the polymers obtained by the interfacial polymerization processes of the present invention consistently have a higher $M_w$ compared to the polymers obtained by the prior art solution polymerization of the same monomers.

TABLE 1

EFFECT OF PROCESS ON MOLECULAR WEIGHT

| Monomer I.D. | Polymerization Process | Molecular Weight $M_w$ | $M_n$ | MWD |
|---|---|---|---|---|
| Monomer A | solution | 100,000 | 56,500 | 1.77 |
| Monomer A | interfacial | 256,00 | 101,900 | 2.51 |
| Monomer B | solution | 133,000 | 58,600 | 2.27 |
| Monomer B | interfacial | 257,000 | 98,500 | 2.61 |

EXAMPLE IV

A layered photoresponsive imaging member comprised of poly[N,N'-diphenyl-N,N'-bis(3-hydroxyphenyl)-{1,1'-biphenyl}-4,4'-diamine] diethylene glycol biscarbonate as the charge transport layer, and a vanadyl phthalocyanine generator layer was fabricated as follows.

A titanized MYLAR® substrate, thickness of 75 microns, was coated using a Bird film applicator with a solution of 1 milliliter of 3-aminopropyltrimethoxysilane in 100 milliliters of ethanol. The coating was heated at 110° C. for 10 minutes resulting in the formation of a 0.1 micron thick polysiloxane layer. A dispersion of a photogenerator prepared by ball milling a mixture of 0.3 gram of vanadyl phthalocyanine and 0.7 gram of VITEL PE-200 TM polyester (Goodyear Chemical) in 70 grams of methylene chloride for 24 hours was then coated with a Bird film applicator on top of the polysiloxane layer. After drying the coating in a forced air oven at 135° C. for 10 minutes, a 0.8 micron thick vanadyl phthalocyanine photogenerating layer was obtained. A charge transport layer was prepared by dissolving 1.5 grams of poly[N,N'-diphenyl-N,N'-bis(3-hydroxyphenyl)-{1,1'-biphenyl}-4,4'-diamine] carbonate obtained with the process of the present invention in 10 milliliters of methylene chloride. A layer of this mixture was formed on top of the photogenerating vanadyl phthalocyanine layer using a Bird film applicator. The coating was then vacuum dried at 110° C. for 20 minutes to form a 22 micron thick dry layer of the charge transporting layer. The layered photoresponsive imaging member was tested electrically as follows.

The xerographic electrical properties of the imaging member were determined by electrostatically charging the surfaces thereof with a corona discharge source until the surface potentials, as measured by a capacitively coupled probe attached to an electrometer, attained an initial value, $V_o$, of about −800 volts. After resting for 0.5 second in the dark, the charged members reached a surface potential of $V_{ddp}$, dark development potential, and each member was then exposed to light from a filtered Xenon lamp with a XBO 150 watt bulb. A reduction in surface potential to a $V_{bg}$ value, background potential, due to photodischarge effect was observed. The background potential was reduced by exposing with a light intensity about 10 times greater than the expose energy. The resulting potential on the imaging member was designated as the residual potential, $V_r$. The dark decay in volt/second was calculated as $(V_o-V_{ddp})/0.5$. The percent of photodischarge was calculated as 100 percent $(V_{ddp}-V_{bg})/V_{ddp}$. The desired wavelength and energy of the expose light was determined by the type of filters placed in front of the lamp. The broad band white light (400 to 700 nanometers) photosensitivity of this imaging member was measured by using an infrared cut-off filter whereas the monochromatic light photosensitivity was determined using narrow band-pass filter. The photosensitivity of the imaging members is usually provided in terms of the amount of expose energy in erg/cm$^2$, designated as $E_{\frac{1}{2}}$, required to achieve 50 percent of photodischarge from the dark development potential. The higher the photosensitivity, the smaller is the $E_{\frac{1}{2}}$ value. The devices or photoconductive members were subjected to 1,000 cycles of repeated charging, discharging and erase to determine the cycling stability.

The imaging member tested according to the procedures described above indicated excellent photosensitivity with $E_{\frac{1}{2}}$ of 4.8 ergs/cm$^2$ for broad band white light and $E_{\frac{1}{2}}$ of 3.3 ergs/cm$^2$ for exposure with 800 nanometers of light and a residual potential of 20 volts. Upon repeated cycling for 1,000 cycles, the device was stable as evidenced by no change in $V_{ddp}$ or $V_r$.

EXAMPLE V

A layered imaging member was fabricated as described in Example IV. More specifically, a solution was prepared by dissolving 1.5 grams of poly[N,N'-diphenyl-N,N'-bis(3-hydroxyphenyl)-{1,1'-biphenyl}-4,4'-diamine] carbonate in 10 milliliters of methylene chloride. A layer of this mixture is formed on top of a 200 millimeters×200 millimeters highly reflective aluminum platen. The coating is then vacuum dried at 110° C. for 20 minutes to form a 22 micron thick dry layer of the charge transport material. A wear test fixture (1) was set up to measure the relative wear and wear rates of charge transport layers subjected to toner interactions and blade cleaning.

The wear test fixture was comprised of a 200 millimeters×200 millimeters platen to which is affixed the test specimen or sample imaging member. The platen rotates at 50 rpm. An abraiding agent, a toner of styrene n-butyl methacrylate, 90 weight percent, carbon black REGAL 330®, 8 weight percent of distearyl dimethyl ammonium methyl sulfate, contained in a cassette was caused to contact the sample from a supply sump, which is located above the platen and supplies the abraiding agent in 0.12 to 0.13 gram amounts every 100 seconds. The abraiding agent was distributed on the test sample by a 9 centimeters long, 2 millimeters thick polyurethane blade used in the Xerox Corporation 5012 machine. The blade was held in the "doctor" configuration at a 21 degree angle to the test sample surface with a normal force of 29 grams/centimeter of blade length. Thickness measurements were obtained by a Photal MCPD-110A Spectro Multichannel Photodetector, a product of Otsuka Electronics. The sample thickness was achieved by averaging from 64 sample sites on the platen and was reproducible to + or −1 nanometer using appropriate calibration standards.

The wear was determined as the loss in thickness of the charge transport layer and is the difference in thickness of the charge transport layer before and after the wear test. The wear is expressed in nanometers. The wear rate is obtained by dividing the wear by the number of cycles and is expressed as nanometers/k cycle. The wear rate is normalized and is independent of any variations in the total number of cycles of the wear tests.

The data obtained is shown in Table 2. Also shown for comparison are results of wear testing with a polycarbonate (MAKROLON 5705®) layer and a charge transport layer comprised of 40 weight percent of N,N'-diphenyl-N,N'-bis(3-methylphenyl)-[1,1'-biphenyl]-4,4'-diamine (TPD) molecularly dispersed in 60 weight percent of polycarbonate (MAKROLON 5705®).

TABLE 2

EFFECT OF POLYMER ON THE WEAR RATE (TEST FIXTURE #1)

| Polymer Binder Sample I.D. | Molecular Weight $M_w$ | $M_n$ | MWD | Wear Rate nm/K Cycle |
|---|---|---|---|---|
| 40% TPD 60% Polycarbonate | | | | 20 |
| Example I Polymer (High $M_w$ by Solution Polymerization) | 200K | 53K | 3.79 | 22 |
| Example II Polymer (High $M_w$ by Interfacial Polymerization) | 241K | 108.9K | 2.2 | 11 |

The results on this wear fixture evidence that the wear rate of the high molecular weight, narrow polydispersity (MWD) poly[N,N'-diphenyl-N,N'-bis(3-hydroxyphenyl)-{1,1'-biphenyl}-4,4'-diamine] diethylene glycol biscarbonate obtained by interfacial polymerization was significantly less by a factor of about 2 compared to a high molecular weight, wide polydispersity (MWD) poly[N,N'-diphenyl-N,N'-bis(3-hydroxyphenyl)-{1,1'- biphenyl}-4,4'diamine] diethylene glycol biscarbonate obtained by solution polymerization as described in U.S. Pat. No. 4,806,443. Furthermore, the wear rate of the high molecular weight, narrow polydispersity (MWD) poly[N,N'-diphenyl-N,N'-bis(3-hydroxyphenyl)-{1,1'-biphenyl}-4,4'-diamine] diethylene glycol biscarbonate obtained by interfacial polymerization of the present invention was significantly less by a factor of about 2 as compared to the wear rate of a charge transport layer of N,N'-diphenyl-N,N'-bis(3-methylphenyl)-[1,1'-biphenyl]-4,4'-diamine (TPD) molecularly dispersed in polycarbonate (MAKROLON 5705®).

EXAMPLE VI

A layered imaging member was fabricated as described in Example IV. Another wear test fixture (#2) was set up to measure the relative wear and wear rates of charge transport layers subjected to toner interactions and blade cleaning. Photoresponsive imaging members fabricated as described above were used by wrapping around and taping onto an aluminum drum in the test fixture. The drum speed controlled by a motor can be varied and was usually maintained at about 55 rpm during the test. Toner was supplied continuously from a hopper and cleaned by a cleaning blade. The typical test conditions during a wear test were described as follows:

| | |
|---|---|
| Toner: | 46.7 percent of polystyrene/n-butylacrylate copolymer, 49.6 percent of cubic magnetite, 1.0 percent of P51 charge control additive, 2.5 percent of polypropylene, and 0.2 percent of AEROSIL R972 ®. |
| Blade: | Xerox Corporation 1065 cleaning blade |
| Drum speed: | 55 rpm |
| Number of cycles: | 50,000 |

A new cleaning blade was used in each test. The blade force was about 30 grams/centimeter and was adjusted by a micrometer mounted on the blade holder. The wear was determined as the loss in thickness of the charge transport layer and was the difference in thickness of the charge transport layer before and after the wear test. The wear was expressed in nanometers. The wear rate was obtained by dividing the wear by the number of cycles and was expressed as nanometers/k cycle: The wear rate was normalized and was independent of any variations in the total number of cycles of the wear tests. The data obtained is shown in Table 3.

TABLE 3

EFFECT OF POLYMER ON THE WEAR RATE

| Polymer binder ID | Wear in 50,000 Cycles μm | Wear Rate nm/K Cycle |
|---|---|---|
| 40% TPD 60% Polycarbonate | 2.3 | 46 |
| Polycarbonate Makrolon 5705 | 1.25 | 25 |
| Example II Polymer | 0.65 | 13 |

Also shown for comparison are results of wear testing with a polycarbonate (MAKROLON 5705®) layer and a charge transport layer comprised of 40 weight percent of N,N'-diphenyl-N,N'-bis(3-methylphenyl)-[1,1'-biphenyl]-4,4'-diamine (TPD) molecularly dispersed in 60 weight percent of polycarbonate (MAKROLON 5705®). The results show that the wear rate of poly[N,N'-diphenyl-N,N'-bis(3-hydroxyphenyl)-{1,1'-biphenyl}-4,4'-diamine] diethylene glycol biscarbonate obtained by interfacial polymerization of the present invention was significantly less, by a factor of about 3 to 4, than the wear rate of a charge transport layer of N,N'-diphenyl-N,N'-bis(3-methylphenyl)-[1,1'-biphenyl]-4,4'-diamine (TPD) molecularly dispersed in the polycarbonate (MAKROLON 5705®). The wear rate of poly[N,N'-diphenyl-N,N'-bis(3-hydroxyphenyl)-{1,1'-biphenyl}-4,4'-diamine] diethylene glycol biscarbonate obtained by interfacial polymerization of the present invention was also less, by a factor of about 2, than the wear rate of a typical noncharge transporting polycarbonate A (MAKROLON5705®).

The electrophotographic member of the present invention exhibits greater resistance to cracking, brazing, crystallization, and phase separation compared to similar imaging members using nonpolymeric aryl amine compounds. It also exhibits significantly improved resistance to abrasion when exposed to blade cleaning devices compared to similar imaging members using nonpolymeric aryl amine compounds or aryl amine polycondensation polymers obtained by solution polycondensation.

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member consisting essentially of a supporting substrate, a photogenerating layer, and a charge transport layer thereover comprised of an aryl amine polycondensation polymer with a high molecular weight of from 50,000 to 350,00, and with a narrow molecular weight distribution ($M_w/M_n$) of from 1.5 to 3.0, respectively, and which member possesses abrasion resistance; with liquid development processes and wherein said imaging member is prepared by coating on the supporting substrate said photogenerating layer and said charge transport layer, which layer is prepared by the interfacial polymerization of an aryl amine diol dissolved in an alkaline aqueous phase with a bifunctional acid halide dissolved in an organic solvent.

2. A photoconductive imaging member in accordance with claim 1 wherein the charge transport layer is comprised of from about 50 percent to about 100 percent by weight of poly[N,N'-diphenyl-N,N'-bis{3-hydroxyphenyl}-{1,1'-biphenyl}-4,4'-diamine] diethylene glycol biscarbonate and from 0 percent to about 50 percent by weight of bisphenol A polycarbonate.

3. A photoconductive imaging member in accordance with claim 1 wherein said polymers possess a molecular weight of from about 75,000 to about 250,000.

4. A photoconductive imaging member in accordance with claim 1 wherein the substrate is a metal.

5. A photoconductive imaging member in accordance with claim 1 wherein the photogenerating layer contains photogenerating inorganic or organic pigments.

6. A photoconductive imaging member in accordance with claim 1 wherein said pigments are selected from the group consisting of metal phthalocyanines, metal free phthalocyanines, vanadyl phthalocyanines, titanyl phthalocyanines, gallium phthalocyanines, selenium, selenium alloys, and trigonal selenium.

7. A photoconductive imaging member in accordance with claim 5 wherein said polycondensation polymer is poly[N,N'-diphenyl-N,N'-bis{3-hydroxyphenyl}-{1,1'-biphenyl}-4,4'-diamine] diethylene glycol biscarbonate.

8. An imaging member in accordance with claim 1 wherein the charge transport layer interfacial polymerization is accomplished in the presence of a phase transfer agent.

9. An imaging member in accordance with claim 8 wherein the phase transfer agent is an arylalkyl ammonium halide.

10. An imaging member in accordance with claim 1 wherein the bifunctional acid halide is a bishaloformate.

11. An imaging member in accordance with claim 1 wherein the molecular weight of said polycondensation polymer is 241,000, 256,000 or 257,000.

* * * * *